United States Patent [19]

Fletcher

[11] 4,392,475

[45] Jul. 12, 1983

[54] BOWSTRING RELEASE DEVICE

[76] Inventor: James D. Fletcher, P.O. Box 218, Bodfish, Calif. 93205

[21] Appl. No.: 229,890

[22] Filed: Jan. 30, 1981

[51] Int. Cl.[3] ..... F41C 19/00; F41C 5/00

[52] U.S. Cl. ..... 124/35 A

[58] Field of Search ..... 124/35 A, 24 R, 23 R

[56] References Cited

U.S. PATENT DOCUMENTS

| | | | |
|---|---|---|---|
| 3,954,095 | 5/1976 | Lewis | 124/35 A |
| 4,083,348 | 4/1978 | Fletcher | 124/35 A |
| 4,156,417 | 5/1979 | Fletcher | 124/35 A |

*Primary Examiner*—Richard C. Pinkham
*Assistant Examiner*—William R. Browne
*Attorney, Agent, or Firm*—Donald E. Nist

[57] ABSTRACT

An improved mechanical bowstring release device has a hollow, preferably generally cylindrical housing having a central space defined by a pair of spaced flanges and a retainer bar pivotably secured to the housing in the space, one end of the bar projecting from the housing when the bar is pivoted into a bowstring-drawing locked position, the bar also being pivotable to a bowstring-releasing unlocked position. A link extends longitudinally of and is pivoted in the housing space and the rear portion thereof defines a V-shaped rearwardly facing receptacle into which is inserted the pointed front portion of a trigger arm. The arm is pivotably secured in the housing space and is rearwardly and laterally of the housing. Couplers connect the front end of the link and the coupling end of the bar. A spring urges the front end of the arm into a position which locks the bar. Finger pressure can pivot that arm front end to cause movement of the link, couplers and bar coupling end to cause the bar to pivot into the unlocked string-releasing position. The device operates smoothly in a safe efficient manner.

2 Claims, 6 Drawing Figures

*Fig. 5*

BOWSTRING RELEASE DEVICE

BACKGROUND OF THE INVENTION

1. Field of the Invention

The present invention generally relates to sports equipment and more particularly to an improved archery bowstring release device.

2. Prior Art

Various types of mechanical archery bowstring release devices have been developed to improve shooting accuracy. The hook or ledge type is very popular. It usually involves a simple metallic or plastic hand-held ring or the like with a hooked projection adapted to engage the bowstring at a single location. When the bowstring is fully drawn and the bow has been fully aimed, the archer turns the ring or allows it to rotate so that the bowstring suddenly slips off the projection and is released. With such a device it is somewhat difficult to exactly reproduce the angle and movements relating to the draw and release from shot-to-shot. Moreover, there is a danger that during the draw, the archer will inadvertently allow the device to slip, prematurely firing the arrow.

So-called rope releases are more desirable in this respect since they usually involve a more or less slip-proof rope retainer. Moreover, the ropes which wrap around and are used to draw the bowstring dampen undesired inaccuracy-producing bowstring vibrations during release of the bowstring. However, in order to release the bowstring from most rope releases, certain hand movements are necessary which are difficult to reproduce from shot-to-shot.

So-called complex trigger-type releases reduce the hand movements which are necessary to trigger the release of the bowstring but are either so complicated and expensive to make so as to be of doubtful use to the average archer or are subject to substantial wear in use, due to the substantial forces imposed on the sear elements of the trigger.

An improved type of mechanical bowstring release device is set forth in U.S. Pat. No. 4,156,417 issued to the present inventor on May 29, 1979. Although that device is a substantial advance in the art, it still has certain deficiencies relating to the ultimate smoothness and feel of the trigger pull, the ability to easily adjust the trigger pull to a fine degree and the safety locking ability of the device.

Accordingly, it would be desirable to provide an improved release device which would be capable of further promoting increased shooting accuracy with a high degree of safety and which would be capable of being fine tuned with respect to the trigger feel and for firing the device with a minimum of hand movement. Preferably such a device would also be used with or without a rope release assist.

SUMMARY OF THE INVENTION

The present invention satisfies the foregoing needs. It is inexpensive, durable, subject to little wear, highly accurate and capable of being used in two different shooting modes, as desired by the archer. It is substantially as set forth in the Abstract above. The bowstring retainer when locked holds the bowstring either by itself or through the use of a rope loop so that the bowstring cannot slip off and fire accidentally. During intentional firing of the bowstring, the retainer smoothly and effortlessly moves to the unlocked position to allow the sudden release of the bowstring. The device can be easily held in the hand, is simple to construct and can be triggered by slight movement of the thumb or finger in a readily reproducible manner. The novel trigger components, that is, the link, coupler and trigger are are essentially wear-free and are pivotably connected to each other in the housing. The device provides improved smoothness of operation and safety over prior art devices. Its trigger pull and feel can be finely adjusted for improved shooting. Various other features are set forth in the following detailed description and the accompanying drawings.

DRAWINGS

DETAILED DESCRIPTION

Figure 1:
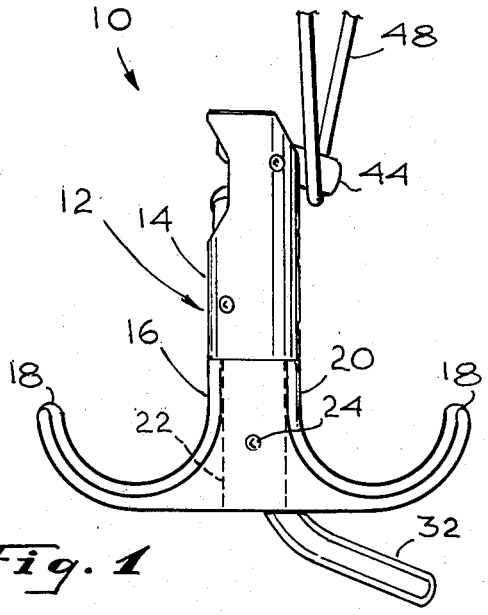
FIG. 1 is a schematic top plan view of a first preferred embodiment of the improved release device of the invention in a cocked or locked position around a bowstring.
Figure 3:
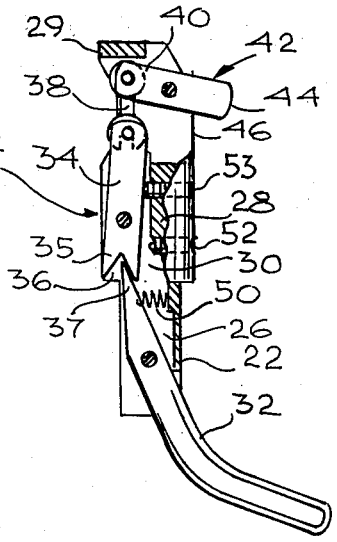
FIG. 3 is a schematic top plan view, partly broken away, of the front portion of the device of FIG. 1 in the locked position.
Figure 4:
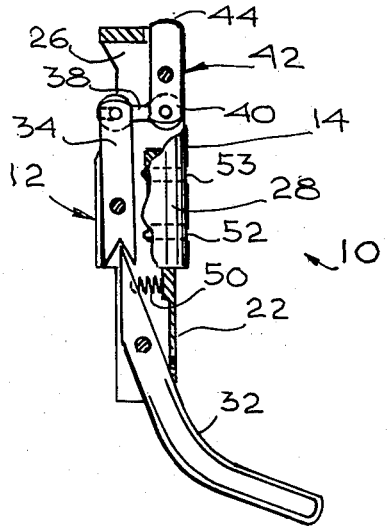
FIG. 4 is a schematic top plan view, partly broken away, of the front portion of the device of FIG. 1 in the unlocked position.

FIGS. 1, 3 and 4

Now referring more particularly to FIGS. 1, 3 and 4, a first preferred embodiment of the improved release device of the present invention is schematically depicted therein. Thus, device 10 is shown which comprises an elongated housing 12 comprising a generally cylindrical forwardly extending front portion 14 and a generally transversely extending rear portion 16. Portion 16 is contoured to provide a pair of finger-receiving wings 18 and a central forwardly extending cylindrical tube 20 slip fitted over the cylindrical rear end 22 of portion 14 and pinned in place, as at point 24.

Cylindrical portion 14 comprises a pair of generally vertically spaced flanges 26 joined on one side thereof by a web 28 (FIG. 5) and at the front end thereof by a vertical web 29, so as to define a space 30. Within space 30 are disposed in longitudinal sequence from rear to front, as shown more particularly in FIG. 3, a trigger arm 32 pivotably secured adjacent its midpoint to flanges 26 and extending rearwardly and laterally of housing 12, an elongated link 34 pivotably secured adjacent its rear end 35 to flanges 26, and releasably contacting the pointed front end 37 of arm 32 at a rearwardly opening V-shaped receptacle portion 36 in end 35, and a coupler 38 pivotably secured adjacent its rear end to the front end of link 34 and adjacent its front end to the coupling end 40 of an elongated retainer bar 42.

Retainer bar 42 is also pivotably connected at about its midpoint to flanges 26. The opposite retaining end 44 of retainer bar 42, when in the locked bowstring-retaining first position shown in FIGS. 1 and 3, extends out through an opening 46 and laterally of housing 12 at a slightly rearward angle. In this position, retainer bar 42 is transverse of portion 14, that is, is at about a right angle to coupler 38, link 34 and front end 37 of trigger arm 32 and cannot rotate end 44 forward. In this position, end 44 can securely hold bowstring 48, allowing the archer to easily draw it rearwardly to the full draw position. So long as trigger arm 32 is not moved, as by the archer's finger, spring 50, secured in portion 14 between flanges 26 and transverse of housing 12, keeps end 37 of trigger arm 32 urged into the locked position. Thus, spring 50 bears transversely against end 37, as shown in FIGS. 3 and 4.

In order to release bowstring 48, after fully drawing the same and aiming an arrow attached thereto, the archer urges the rear end of arm 32 rearwardly and transversely, causing the front end 37 of arm 32 to rotate against spring 50, in turn rotating the rear end of link 34 in the same direction, and rear end of coupler 38 in the opposite direction, out of alignment with link 34. Retainer bar 42 is, in turn, rotated so that end 44 moves from the transverse bowstring-holding locked position of FIGS. 1 and 3 to the unlocked fired position of FIG. 4. During this rotation, bowstring 48 slips from end 44 and is suddenly released, firing an arrow disposed thereon.

It will be understood that so long as coupler 38 is in line with link 34 (FIG. 3), force applied to end 44 of retainer 42, such as the force applied by the drawn bowstring 50, cannot cause coupler 38 to rotate. It is only when arm 32 is moved, as described above, so that coupler 38 comes out of direct alignment with link 34, that the bowstring force on end 44 can smoothly and rapidly allow end 44 to be rotated forward to effect the desired bowstring release. It will also be understood that after such release (FIG. 4), because link 34 and coupler 38 are still out of alignment, slight finger pressure applied to end 44 is all that is needed to cause it to easily rotate to the locked (cocked) position of FIG. 3.

The degree of force needed to be applied to the rear end of arm 32 to cause it to move sufficiently far to cause the firing of the trigger mechanism (release of bowstring 50) can be regulated through adjustment of spring 50 in space 30 as by an adjustment screw (not shown) and also by limit screws 52 and 53 extending transversely through portion 14 adjacent to and directed towards opposite ends of 34. Other mans of adjusting this force are also contemplated. Spring 50 also assures that link 34 will be properly longitudinally aligned with coupler 38 in the locked position of FIG. 3. The V-shape of end 35 and pointed end 37 of arm 32 allow the trigger pull and feel to be carefully adjusted for maximum ease of release. By spring loading arm 32 and removing the spring 50 from link 34, the spring force applied by arm 32 through end 35 holds release 10 in a safe position. When arm 32 is moved toward the firing position, there is created a certain amount of spring loaded free play within end 35. All spring loading of link 34 is thus removed. When arm 32 is moved still further towards the firing position, end 37 contacts link 34 through end 35 and creates instant release of member 42 with very little added pressure. The trigger action can be made to resemble a two step set trigger such as is used in the finest match rifles. A slight change of shape of retainer bar 42 can also be employed, if desired, to make member 42 self-locking when inserted on bowstring 48.

If desired, the relative angle of link 34, couple 38 and end 40 can be changed in manufacturing device 10 without increasing the trigger pressure necessary for release, so that the coupler 38 is not in line with link when bar 42 is in the locked position (FIG. 3), but is angled to be "past center" in a direction to further assure that inadvertent unlocking of bar 42 will not occur.

FIG. 2

Figure 2:
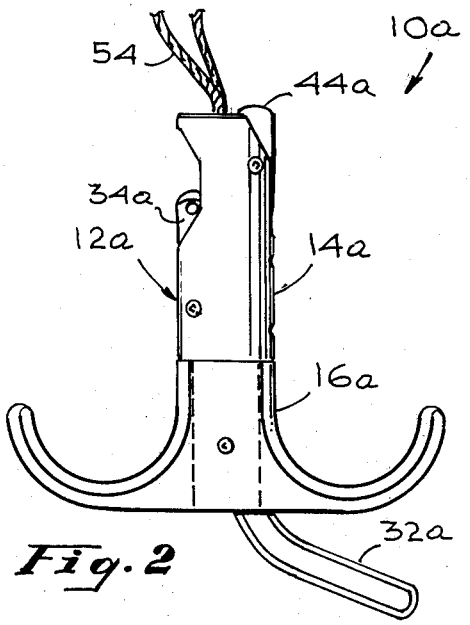
FIG. 2 is a schematic top plan view of a second preferred embodiment of the device of the present invention in an unlocked position after release of the bowstring.

Device 10 can be modified to include a release rope. Thus, in FIG. 2, device **10*a* is shown which is identical to device 10 except that it includes release rope 54 in the form of a closed loop, the ends of which are secured to web 28. Rope 54 is looped around a bowstring and then the retainer bar when it is to be used. All other functions are identical to device 10**.

FIG. 5

Figure 5:
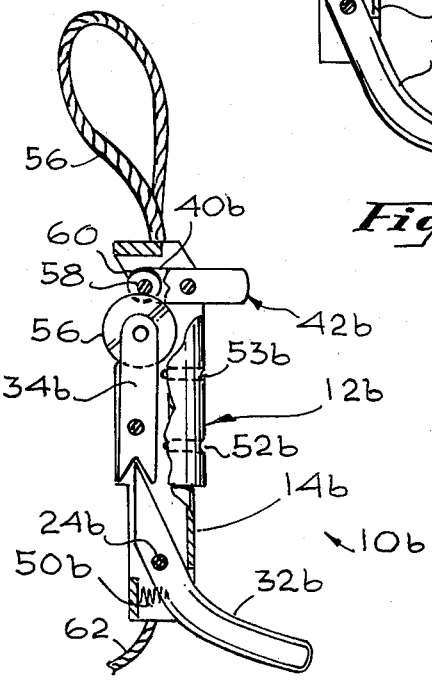
FIG. 5 is a schematic plan view, partly broken away, of a third preferred embodiment of the device of the present invention; and, FIG. 6 is a schematic top plan view, partly broken away, of a fourth preferred embodiment of the present invention.

A third preferred embodiment of the improved release device of the present invention is schematically depicted in FIG. 5. Thus device **10*b* is shown which is substantially identical to device 10. Components thereof similar to those of device 10 bear the same numerals but are succeeded by the letter "b". Device 10*b* differs from device 10 only in the following respects. No tube and wings are provided; a loop 56 similar to loop 54 is secured to device 10*b* and, instead of a coupler like coupler 38, the front end of link 34*b* has a wheel 56 rotatably secured thereto, which wheel 56 bears on a cross bar 58 disposed in a slot 60 in end 40*b* of bar 42*b* so that bar 42*b* is held in this locked position of FIG. 5 until wheel 56 is moved laterally outwardly of housing 12*b* with the front end of link 34*b* by action of trigger arm 32*b* thereon. Moreover, a wrist strap or the like (not shown) may be connected to portion 14*b* through a cord 62 disposed through opening 24*b*. In addition, spring 50*b* is below the pivot point of arm 32*b*. Device 10*b* is otherwise similar in construction and function to device 10**.

FIG. 6

Figure 6:
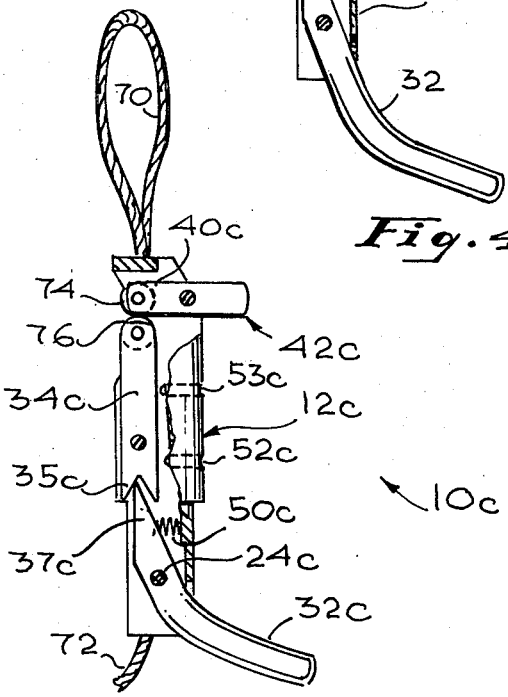

A fourth preferred embodiment of the improved present release device is schematically depicted in FIG. 6. Thus, device **10*c* is shown, substantially similar to device 10, with similar components thereof bearing the same numerals but succeeded by the letter "c". Device 10*c* differs from device 10 by including a closed loop 70, by having no tube like tube 20 and wings 18, by employing a wrist strap (not shown) connected by a cord 72 through point 24*c* and by not employing a coupler like 38 but instead two unconnected wheels 74 and 76 rotatably secured, respectively, to end 40*c* and the front end of link 34*c*. Wheels 74 and 76 are dimensioned and positioned to permit release of bar 42*c* to the unlocked position only when wheel 76 is moved laterally outwardly enough on link 34*c* to clear wheel 74. This movement is effected by action of arm 32*c* on end 35*c* of link 34*c*. In all other respects devices 10 and 10*c*** are similar in construction and function.

The described improved release device of the present invention can be fabricated of metal and/or other suitable components and has been found in practice to be durable, inexpensive and highly efficient. Various modifications, changes, alterations and additions can be made in the present device and its components and parameters. All such modifications, changes, alterations and additions as are within the scope of the appended claims form part of the present invention. It is understood that all components shown may be interchangeably used in all preferred embodiments.

What is claimed is:

1. An improved mechanical bowstring release device comprising, in combination:

a. a hollow housing having a space therein;

b. a link positioned in said space;

c. a bowstring retainer pivotably secured in said space in said housing and including a retaining end extending through an opening in said housing when said retainer is in a locked bowstring-drawing first position, said retaining end being movable to an unlocked bowstring-releasing second position, said retainer also including a coupling end; and, d. trigger means for locking said retainer in said first position and for urging said retainer into said unlocked second position to release said bowstring, said trigger means including:

i. coupling means comprising a slot in said retainer coupling end with a bearing point in said slot and a wheel rotatably secured to the front end of said link and releasably engageable with said bearing point, ii. said link being pivotably secured to and extending longitudinally of said housing in said space, the front portion of said link being engaged with said coupling means, the rear portion of said link defining a rearwardly facing receptacle, iii. a trigger arm extending outwardly of said housing through an opening therein and pivotably secured in said space behind said link, the front portion of said trigger arm extending into said receptacle, and, iv. an automatic locking spring disposed in said space generally laterally against the portion of said trigger arm which is forward of the pivot point of said arm, said spring urging said front portion of said trigger arm against said link to move said coupling means to a position to cause said retainer to move into said first locked position, whereby movement of said trigger arm against said spring is necessary to urge said link and coupling means to move said retainer to said second unlocked position to effect instant release of said bowstring.

2. An improved mechanical bowstring release device comprising, in combination:

a. a hollow housing having a space therein;

b. a link positioned in said space;

c. a bowstring retainer pivotably secured in said space in said housing and including a retaining end extending through an opening in said housing when said retainer is in a locked bowstring-drawing first position, said retaining end being movable to an unlocked bowstring-releasing second position, said retainer also including a coupling end; and, d. trigger means for locking said retainer in said first position and for urging said retainer into said unlocked second position to release said bowstring, said trigger means including:

i. coupling means comprising a first wheel secured to said coupling end of said retainer, and a second wheel rotatably secured to the front end of said link and releasably engageable with said first wheel, ii. said link being pivotably secured to and extending longitudinally of said housing in said space, the front portion of said link being engaged with said coupling means, the rear portion of said link defining a rearwardly facing receptacle, iii. a trigger arm extending outwardly of said housing through an opening therein and pivotably secured in said space behind said link, the front portion of said trigger arm extending into said receptacle, and, iv. an automatic locking spring disposed in said space generally laterally against the portion of said trigger arm which is forward of the pivot point of said arm, said spring urging said front portion of said trigger arm against said rear portion of said link in a direction which causes said link to move said coupling means to a position to cause said retainer to move into said first locked position, whereby movement of said trigger arm against said spring is necessary to urge said link and coupling means to move said retainer to said second unlocked position to effect instant release of said bowstring.

* * * * *